United States Patent [19]

Shindo et al.

[11] Patent Number: 4,795,690

[45] Date of Patent: Jan. 3, 1989

[54] TONERS FOR ELECTROPHOTOGRAPHIC PROCESS CONTAINING A PHENOLIC COMPOUND

[75] Inventors: Seizin Shindo, Yono; Hiroomi Hosoi, Urawa; Masaki Shinmoto, Yono, all of Japan

[73] Assignee: Nippon Kayaku Kabushiki Kaisha, Tokyo, Japan

[21] Appl. No.: 79,758

[22] Filed: Jul. 30, 1987

[30] Foreign Application Priority Data

Aug. 4, 1986 [JP] Japan ..... 61-181862

[51] Int. Cl.[4] ..... G03G 9/08

[52] U.S. Cl. ..... 430/109; 430/110

[58] Field of Search ..... 430/109, 110

[56] References Cited

FOREIGN PATENT DOCUMENTS 61-3149 9/1986 Japan .

OTHER PUBLICATIONS

Chemical Abstracts, vol. 105, 1986, p. 590.

Derwitt Abstract J61003149.

*Primary Examiner*—John L. Goodrow

*Attorney, Agent, or Firm*—Henry C. Nields

[57] ABSTRACT

A toner for electrophotographic process which comprises the compound represented by the following formula (1).

(1)

The compound acts as a charge control agent in the toner and is good in compatability with a binder and the toners prepared using it are excellent in specific chargeability and good in charge durability due to moisture resistance.

4 Claims, 2 Drawing Sheets

TONERS FOR ELECTROPHOTOGRAPHIC PROCESS CONTAINING A PHENOLIC COMPOUND

BACKGROUND OF THE INVENTION

1. Field of the Invention

This invention relates to a toner for electrophotographic process. More particularly, it relates to toners for electrophotographic process which comprise a specific phenolic compound.

2. Description of the Prior Art

Electrophotographic (imaging) process referred to as xerographic imaging process or xerography are well known (U.S. Pat. No. 4066563, etc.)

General methods for image formation utilizing static electricity comprise charging toners by contact friction with carriers such as glass beads, iron powders, etc., allowing to develop an electrostatic latent image formed on a photoreceptor made of a photoconductive material (selenium, zinc oxide, cadmium sulfide, etc.) and further fixing the developed image by heat, pressure, etc.

In general, colored fine particles called toners comprise a binder as a principal component, a colorant and a charge control agent as essential components and furthermore a fluidizing agent, an antifoggant, etc., among which a charge control agent which has functions of preservation of charge produced by friction with carriers and regulation of charge characteristics of toners is an especially important component in the toner components.

Quality characteristics required for toners are chargeability and charge durability (an ability to maintain a charge for a long time), fluidity, etc. and these are all greatly influenced by a charge control agent used.

Hitherto, as charge control agents for toners, there have been known 2:1 type metal complex dyes [Japanese Patent Publication (Kokoku) Nos. 26478/70 and 201531/66], phthalocyanine pigment [Japanese Patent Application Kokai (Laid-open) No. 45931/77], metallic complexes of salicylic acid Japanese Patent Application Kokai (Laid-open) No. 122726/78), metallic complexes of aromatic dicarboxylic acids [Japanese Patent Publication (Kokoku) No. 7384/84], nigrosine dyes, various quaternary amines (The Journal of Electrostatic Society, 1980, Vol. 4, No. 3, Page 144). However, toners having such charge control agents do not satisfy the quality characteristics required for toners such as chargeability, durability of charge etc.

For example, toners containing 2:1 metal complex dyes known as negative charge control agents show a moderate level in chargeability, but are poor in adhesion property to bases such as paper and are not satisfactory in moisture resistance and so are low in durability of charge. Thus, they are inferior in repetition property in image formation (copy).

Furthermore, 2:1 metal complex dyes have the that they can be used only for black toners or toners having hues near to black because they have black hue or hues near to black. As a nearly colorless negative charge control agent, there are metal complexes of aromatic dicarboxylic acid [Japanese Patent Publication (Kokoku) No. 7384/84], but they also have defects that they cannot become completely colorless and are inferior to 2:1 metal complex dyes in chargeability. As colorless negative charge control agents which are similar to 2:1 metal complex dyes in chargeability, there are compounds reported in Japanese Patent Application Kokai (Laid-open) No. 3149/86, but since melting points of such compounds are lower than a processing temperature (180°–260° C.) in preparing toners various troubles occur and preparation of stable toners is difficult.

Development of toners has been demanded which are superior in chargeability and charge durability and show stable processability at preparation thereof with use of charge control agents which are colorless and have a wide variety of applications. Furthermore, use of charge control agents free from heavy metals is preferred for prevention of environmental pollution.

SUMMARY OF THE INVENIION

As a result of the inventors' intensive researches in an attempt to develop toners which satisfy the above requirements, it has been found that toners which are superior in chargeability and charge durability and are not influenced by thermal history given during preparation of toners can be obtained by including in the toners the compound represented by the following formula (1):

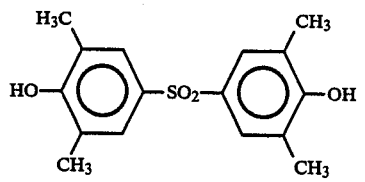

(1)

DETAILED DESCRIPTION OF THE INVENTION

The compound of the formula (1) acts as a charge control agent and this is good in compatibility with binders and when it is contained in toners, the toners are high in specific chargeability and besides high in charge durability due to moisture resistance. Therefore, the present toners are superior in repetition property in image formability. Furthermore, the compound of the formula (1) has a melting point higher than a processing temperature in preparing toners and therefore the toners comprising the compound of the formula (1) can be produced very stably.

The compound of the formula (1) can be prepared, for example, referring to Japanese Patent Publication (Kokoku) No. 18541/68, by the following process.

Figure 1:
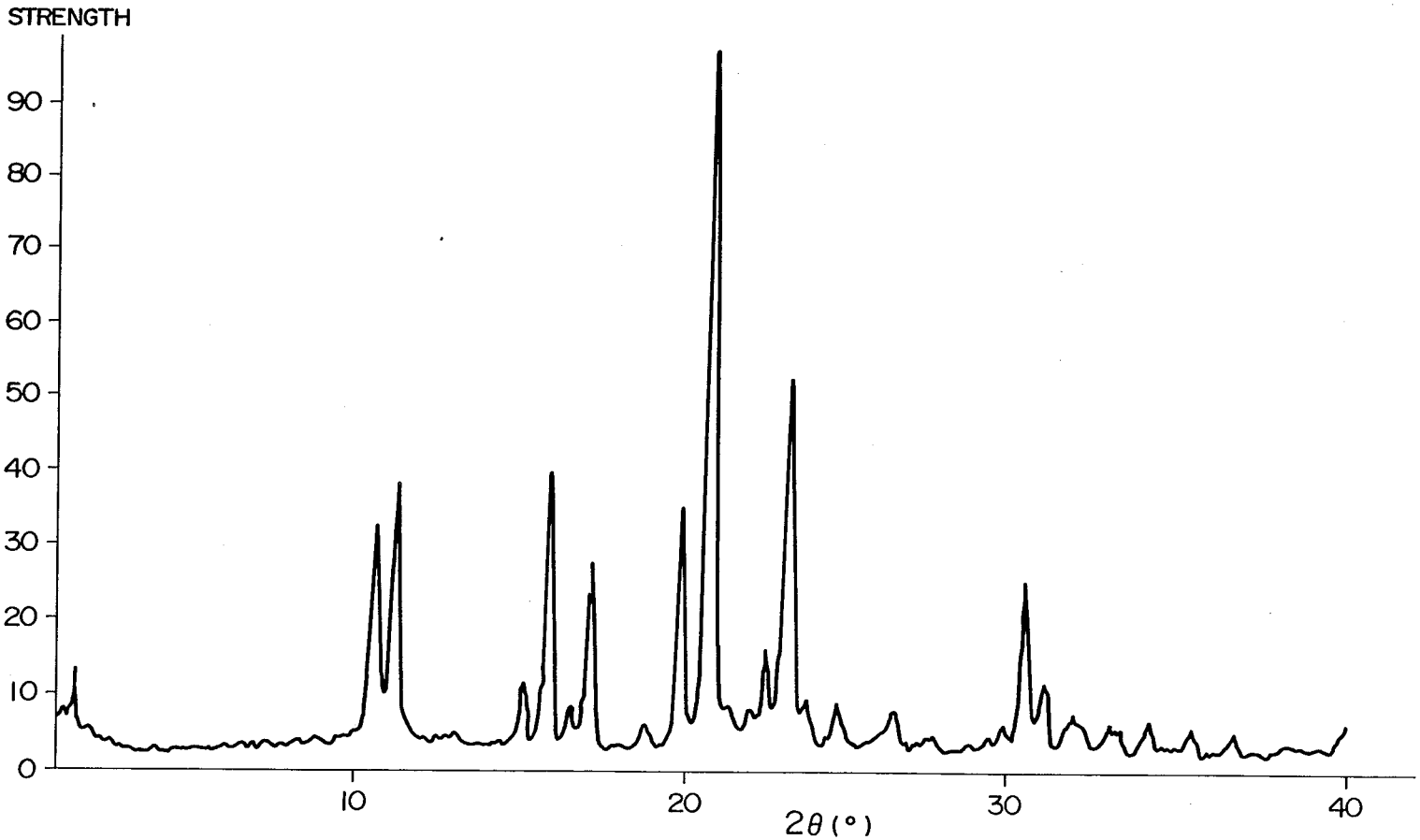
FIG. 1 is an X-ray diffraction pattern of α-type crystal of the compound of the formula (1) and FIG. 2 is an X-ray diffraction pattern of β-type crystal of the compound of the formula (1).
Figure 2:
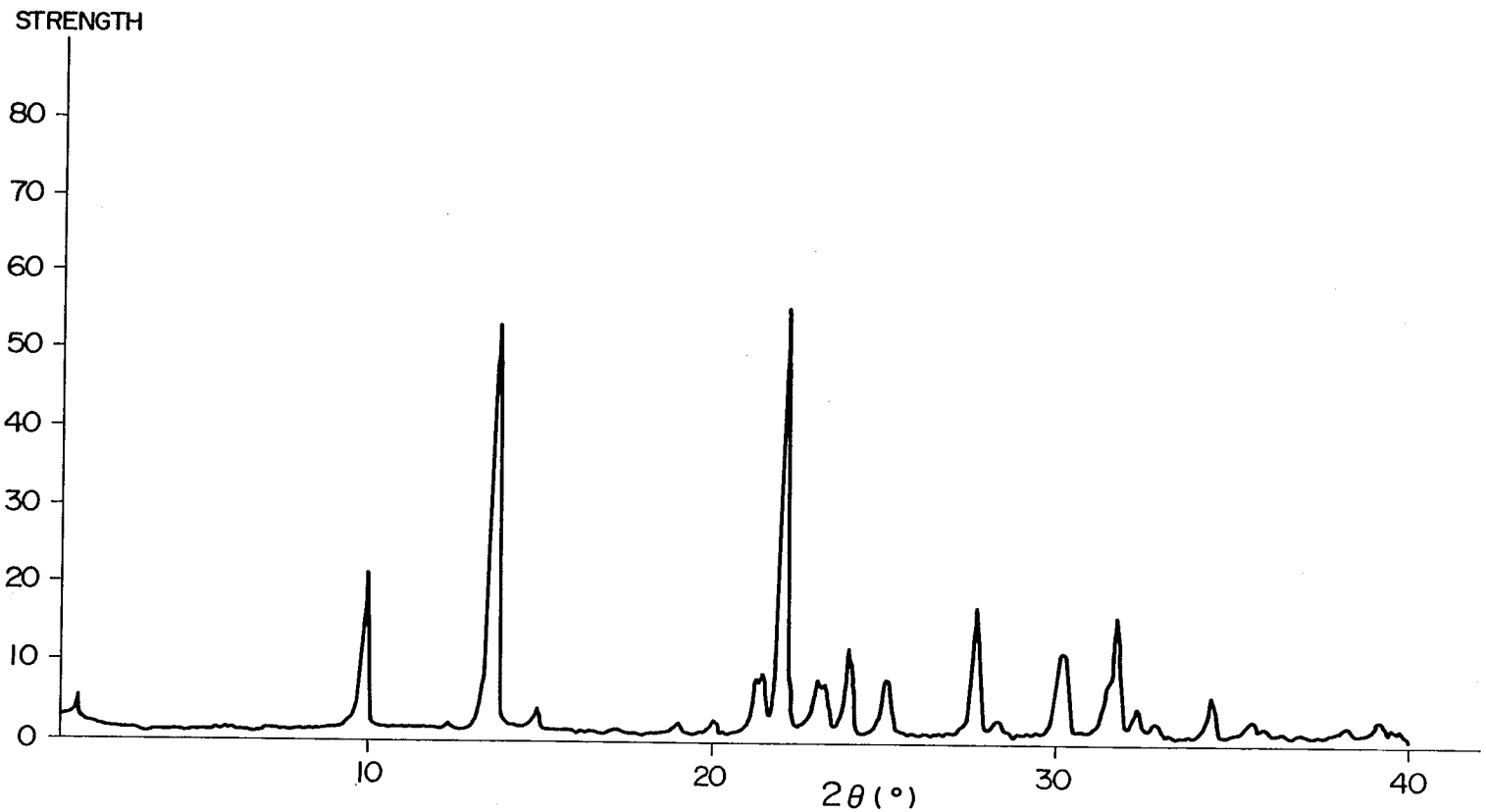

61 g of 2,6-xylenol and 50 ml of n-octane are charged in a 200 ml flask and heated to 80° C. with stirring. Then, after 25.8 g of concentrated sulfuric acid is added dropwise thereto, the reaction temperature is further elevated to 140°–180° C. and water produced is azeotropically removed. From thus obtained reaction mixture, a crystal is collected by filtration, washed, taken out and then dried at 80° C. to obtain the compound of the formula (1). (Yield: 72.7 g, 95.0%). The compound thus obtained has a crystal form (α-type crystal) which gives an X-ray diffraction pattern as shown in FIG. 1 attached hereto. As is clear from FIG. 1, it has intensive peaks at 10.7, 11.3, 15.9, 17.2, 19.9, 20.8, 23.4 and 30.6 (o). This α-type crystal of the compound (1) is dissolved in an aqueous sodium hydroxide solution, then neutralized with hydrochloric acid, collected by filtration, washed and dried at 80° C., whereby the compound having another crystal form (β-type crystal) can be obtained. This crystal gives an X-ray diffraction pattern as shown in FIG. 2.

For practice of this invention, either α-type or β-type crystal may be used, but α-type crystal is more preferable.

Toners for electrophotographic process which comprise the compound of the formula (1) may be produced by a method known per se, for example, by kneading a mixture consisting of the compound of the formula (1), a colorant and a binder under melting (normally heated to 180°–260° C.) by an apparatus capable of effecting heat treatment such as a heating kneader, a twin roll or the like, solidifying the kneaded mixture with cooling and milling the solidified mixture to a particle size of 1–50 μ in a mill such as a jet mill, a ball mill or the like. It is also possible to employ a method comprising once dissolving (in partially dispersed state) a mixture consisting of the compound of the formula (1), a colorant and a binder in an organic solvent or the like, introducing a solution of the mixture into water to precipitate a solid matter and milling this solid matter in the said manner. Examples of binders are acrylic resins, polystyrene resins, styrene-methacrylate copolymers, epoxy resins, polyester resins, etc. and those of colorants are Kayaset Red A-G (CI Solvent Red 179 manufactured by Nippon Kayaku Co. Ltd.), Kayaset Blue F R (CI Solvent Blue 105 manufactured by Nippon Kayaku Co. Ltd.), CI Solvent Yellow 114, carbon black, etc. Binders (electrographic resins) and colorants disclosed in U.S. Pat. No. 4066563 may be also employed.

Amount of the compound of the formula (1) used is 0.5–30 parts by weight (preferably 0.5–10 parts by weight) for 100 parts by weight of binders.

If necessary, a fluidizing agent such as silicon oxide, an antifoggant such as a mineral oil, metallic soaps, or known charge control agents such as metal complexes of aromatic dicarboxylic acid etc. may be added to the present toners.

Since the compound of the formula (1) is colorless and inherent hues of dyes or pigments are not damaged at all, it is possible to select dyes or pigments of optional hues as colorants depending on hues required for toners. With reference to the chargeability which is an important characteristic as charge control agents, those of toners containing known charge control agents were as follows (approximate): -(40–50)μc/g for a metal complex of salicylic acid: -(90–100)μc/g for the compound of Japanese Patent Application Kokai (Laid-open) No. 3149/86; and -(70–80)μc/g for a 2:1 metal complex dye, while the present toners containing the compound of the formula (1) have-(140–150)μc/g which is a superior level and thus they can afford very clear images in electrophotographic process. Moreover, since the present toners comprising the compound of the formula (1) are very high in moisture resistance, they have high level in repetition property in image formation and high charge durability. Besides, the compound of the formula (1) has a high melting point, namely, 300°–305° C., and has conspicuously high heat stability as compared with other 4,4'-dihydroxydiphenyl derivatives. Therefore, they are not influenced by thermal history given during preparation of toners and the presents toner can be stably produced.

Since the compound of the formula (1) contains no heavy metals, there is little possibility of environmental pollution. In using the present toners, there is little possibility in staining white part of paper in electrophotographic process.

The toners by this invention are mixed with carriers to form developers. Carriers may be optionally chosen from known ones. For example, there may be used magnetic powders such as iron powders, glass beads and those, surfaces of which are treated with a resin. Mixing ratio of the toners and carriers is usually toners:-carriers = 1:2–40 (by weight).

This invention will be illustrated by the following examples, wherein "part" means "part by weight" unless otherwise notified.

EXAMPLE 1

| (Toner components) | |
|---|---|
| Styrene-methyl acrylate copolymer (binder) | 100 parts |
| Compound of the formula (1) (α-type crystal) | 2 parts |
| Carbon black (colorant) | 5 parts |

(Procedure of toner formation)

A mixture consisting of the above-mentioned components was melt-mixed in a heating kneader (220° C × 10 minutes) and cooled to obtain a solidified mixture. Then the solidified mixture was coarsely milled with a hammer mill and then classified to 5–10 μ in a jet mill provided with a classification device to obtain a toner of this invention. This procedure was repeated five times to obtain five toners (No. 1–No. 5 toners).

(Developer and chargeability test)

Each of the five toners was mixed with iron powder carrier of 200 meshes at a weight ratio of 5:95 (toner:iron powder toner) to obtain five developers (No. 1 to No. 5 developers). Specific chargeabilities of each of the No. 1–No. 5 developers at right after preparation of the toners (A) and after leaving to stand at a humidity of 100% for one week (B) were measured by a Blow-off device. (manufactured by Toshiba Chemical Co., Ltd.) These chargeability tests on the five developers were carried out in order to evaluate reproducibility in toner formations. The results were shown in Table 1.

(Example 1: Nos 1–5, A-B)

(Copy tests)

Five thousand copies were made with a copying machine (FUJI XEROX 4790) using a developer obtained by mixing a toner prepared in the said manner and carrier (iron powder) at right after mixing and after leaving to stand at a humidity of 100% for one week. The developer, right after mixing and after leaving to stand for one week, afforded clear copies excellent in gradation with no difference between the first copy and the 5000th copy.

The 5000th copy was subjected to a staining test using a developer left to stand at a humidity of 100% for one week after mixing as explained below to find that degree of staining was low as shown in Table 1.

Staining test: In accordance with JIS L-0823, the surface of broad image on the 5000th copy is rubbed 100 times with a white non-rigid vinyl chloride sheet (made of 50 parts of polyvinyl chloride resin, 45 parts of dioctylphthalate and 5 parts of titanium oxide) by a friction tester according to the Japan Society for Promotion of Scientific Research. Degree of stain of the vinyl chloride sheet after having been rubbed is evaluated by the gray scale of JIS staining test. The results of evaluation are expressed in 5 grades of rating from grade 1 to grade 5 and greater grade means lower degree of stain.

EXAMPLE 2

| | |
|---|---|
| Polyester resin | 200 parts |
| Compound of the formula (1) (β-type crystal) | 3 parts |
| Carbon black | 5 parts |

The above components were mixed and milled in a ball mill, then melt-kneaded by a heating kneader (250° C.×15 minutes), solidified by cooling and thereafter, milled and classified in a jet mill provided wth a classification device to obtain the present toner of 5–8 μ. In the same manner as in Example 1, No. 1–No. 5 toners were obtained. Each developer was tested for chargeability to obtain the results as shown in Table 1. (Example 2; Nos. 1–5 A,B). Furthermore, the toner was mixed with the same carriers as used in Example 1 to obtain a developer and 5000 copies were made with a copying machine (RICOPY FT-5050 manufactured by Ricoh Co., Ltd.) using the developers obtained at right after mixing and after leaving to stand at a humidity of 100% for one week. Both of the developers obtained just after mixing and the developer obtained after leaving to stand for one week afforded similarly clear images superior in gradation.

EXAMPLE 3

| | |
|---|---|
| Polyester resin (binder) | 100 parts |
| Compound of the formula (1) (α-type crystal) | 3 parts |
| Kayacet Blue FR (manufactured by Nippon Kayaku Co. Ltd., C.I. Sol. B-105) | 8 parts |

A mixture consisting of the above-mentioned components was melt-mixed in a heating kneader (210° C.×10 minutes) and cooled. The solidified mixture was coarsely milled with a hammer mill and then classified to 5–10 μ in a jet mill provided with a classification device to obtain a blue toner of the present invention.

COMPARATIVE EXAMPLE 1

Developers were prepared in the same manner as in Example 1 except that a 2:1 Cr complex dye of the following structure (A) was used in place of the compound of the formula (1). The results of chargeability test and staining test carried out in the same manner as in Example 1 are shown in Table 1. In the same manner as in Example 1,5000 copies were produced using the developers to find that the 5000th copy showed fogging phenomena and was low in clearness of images as compared with the first copy. Thus, the developers were inferior in repetitive formation of image.

(A)

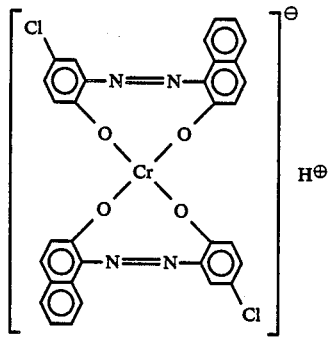

COMPARATIVE EXAMPLE 2

Developers were prepared in the same manner as in Example 1 except that 4,4'-dihydroxy-diphenyl compound represented by the following formula (B) was used in place of the compound of the formula (1). Specific chargeabilities of the resulting developers were measured in the same manner as in Example 1 to obtain the results as shown in Table 1. As is clear from the results, there were great irregularities in specific chargeability among the No. 1–No. 5 samples and thus they were inferior in processing stability. Staining test was also carried out in the same manner as in Example 1.

(B)

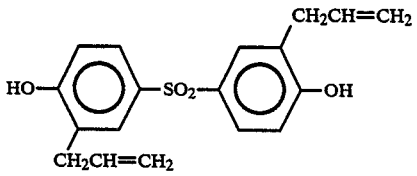

TABLE 1

| | Specific chargeability | | | | | | | | | | Staining test (rating grade) |
|---|---|---|---|---|---|---|---|---|---|---|---|
| | No. 1 | | No. 2 | | No. 3 | | No. 4 | | No. 5 | | |
| | A | B | A | B | A | B | A | B | A | B | |
| Example 1 | −24.7 | −24.6 | −24.6 | −24.6 | −24.3 | −24.4 | −25.1 | −24.9 | −24.8 | −24.8 | 4–5 |
| Example 2 | −24.0 | −23.9 | −23.8 | −23.9 | −24.0 | −23.9 | −23.8 | −23.9 | −24.1 | −23.9 | 4–5 |
| Comparative Example 1 | −19.4 | −2.2 | −18.9 | −2.6 | −19.7 | −2.4 | −19.2 | −2.0 | −18.8 | −2.0 | 1–2 |
| Comparative Example 2 | −23.3 | −23.1 | −20.4 | −20.0 | −19.2 | −19.1 | −26.4 | −25.9 | −21.2 | −20.8 | 4–5 |

In the above table, specific chargeabilities (μc/g) were measured on the developers obtained right after preparation of a toner (A) and after leaving to stand at a humidity of 100% for one week (B), rating grades in staining tests were evaluated on the 5000th copy obtained in copy tests which carried out using the developers which left to stand at a humidity of 100% for one week and after mixing the toners with carriers and No. 1 to No. 5 are sample numbers of the toners on Examples 1–2 and Comparative test 1–2.

It is evident from the above comparative tests that the present toners comprising the compound of the formula (1) were superior to the conventional toners in that they had in combination, the characteristics of greater specific chargeability, better charge durability and better processing stability and less staining property.

What we claimed is:

1. A toner for electrophotographic process which comprises the compound represented by the following formula (1).

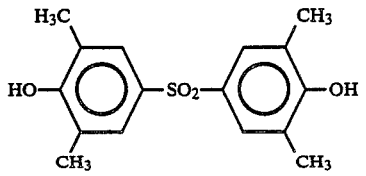

(1)

2. The toner of claim 1 wherein the size of the said toner is 1–50 $\mu$.

3. The toner of claim 1 wherein the said compound is $\alpha$-form crystal, which gives intensive peaks at 10.7, 11.3, 15.9, 17.2, 19.9, 20.8, 23.4 and 30.6 (o) on an X-ray diffraction pattern.

4. A use of the compound of the formula (1) as a charge control agent.

* * * * *